US010413952B2

(12) United States Patent
Matsumoto et al.

(10) Patent No.: US 10,413,952 B2
(45) Date of Patent: Sep. 17, 2019

(54) COILER DEVICE AND GATE DEVICE PROVIDED WITH GUIDE UNIT

(71) Applicants: PRIMETALS TECHNOLOGIES JAPAN, LTD., Tokyo (JP); JFE STEEL CORPORATION, Tokyo (JP)

(72) Inventors: Hiroshi Matsumoto, Hiroshima (JP); Yusuke Ogaki, Hiroshima (JP); Takayuki Endo, Tokyo (JP); Takao Uchiyama, Tokyo (JP); Tsutomu Sugiyama, Tokyo (JP); Takeshi Chiba, Tokyo (JP)

(73) Assignees: PRIMETALS TECHNOLOGIES JAPAN, LTD., Tokyo (JP); JFE STEEL CORPORATION, Tokyo (JP)

( * ) Notice: Subject to any disclaimer, the term of this patent is extended or adjusted under 35 U.S.C. 154(b) by 445 days.

(21) Appl. No.: 15/127,274

(22) PCT Filed: Mar. 18, 2015

(86) PCT No.: PCT/JP2015/057977
§ 371 (c)(1),
(2) Date: Sep. 19, 2016

(87) PCT Pub. No.: WO2015/141703
PCT Pub. Date: Sep. 24, 2015

(65) Prior Publication Data

US 2017/0106424 A1 Apr. 20, 2017

(30) Foreign Application Priority Data

Mar. 20, 2014 (JP) ..... 2014-059066

(51) Int. Cl.
*B21C 47/06* (2006.01)
*B21C 47/34* (2006.01)
(Continued)

(52) U.S. Cl.
CPC ..... *B21C 47/3441* (2013.01); *B21C 47/06* (2013.01); *B21B 39/14* (2013.01); *B21B 2015/0057* (2013.01)

(58) Field of Classification Search
CPC . B21B 2015/0057; B21B 39/14; B21B 39/18; B21C 47/04; B21C 47/06; B21C 47/34; B21C 47/3433; B21C 47/3441
See application file for complete search history.

(56) References Cited

U.S. PATENT DOCUMENTS 1,882,219 A * 10/1932 Harwood ..... B65H 18/16 72/12.8
2,184,118 A * 12/1939 Glenn ..... B21B 39/16 72/250
(Continued)

FOREIGN PATENT DOCUMENTS

CN 201500695 U 6/2010
DE 198 35 110 A1 2/2000
(Continued)

OTHER PUBLICATIONS

International Search Report, issued in PCT/JP2015/057977 (PCT/ISA/210), dated Jun. 9, 2015.
(Continued)

*Primary Examiner* — Edward T Tolan
(74) *Attorney, Agent, or Firm* — Birch, Stewart, Kolasch & Birch, LLP

(57) ABSTRACT

This gate device is provided with a guide unit having a guide section that is disposed at the downstream side of pinch rollers at a path line along which a metal sheet is conveyed, opens/closes a coil-up line that is curved from the path line, and guides the upwards-facing surface side of the metal sheet led in to the coil-up line. A configuration is adopted such that the guide unit has a main body frame and a liner that is attached to the main body frame, forms at least a
(Continued)

portion of the second guide surface that guides the metal sheet, has a lower coefficient of friction than the main body frame, and has a lower hardness than that of the metal sheet.

4 Claims, 5 Drawing Sheets

(51) Int. Cl.
*B21B 15/00* (2006.01)
*B21B 39/14* (2006.01)

(56) References Cited

U.S. PATENT DOCUMENTS 2,990,129 A * 6/1961 Russell ..... B21C 47/063 72/148
4,964,587 A * 10/1990 Oki ..... B21C 47/063 242/532
6,039,283 A 3/2000 Munoz-Baca et al.
6,283,403 B1 * 9/2001 Braun ..... B21C 47/06 242/532.2
6,371,400 B1 * 4/2002 Morimoto ..... B21C 47/06 242/532.2
7,059,161 B2 * 6/2006 Armenat ..... B21B 38/02 72/11.7
7,222,814 B2 * 5/2007 Bohn ..... B21C 47/02 242/531.1
2006/0144981 A1 * 7/2006 Klein ..... B21C 47/34 242/360
2016/0221057 A1 * 8/2016 Hofmann ..... B21C 47/22

FOREIGN PATENT DOCUMENTS

DE 101 62 433 A1 7/2003
EP 0 958 867 A2 11/1999
JP 64-6977 Y2 2/1989
JP 2001-191114 A 7/2001
JP 2005-305452 A 11/2005
JP 2012-250283 A 12/2012

OTHER PUBLICATIONS

Written Opinion of the International Searching Authority, issued in PCT/JP2015/057977 (PCT/ISA/237), dated Jun. 9, 2015.
Extended European Search Report dated Nov. 8, 2017 issued in corresponding European Application No. 15764898.1.
Office Action dated Nov. 13, 2017 issued in corresponding Korean Application No. 10-2016-7025458.
Office Action received Jun. 22, 2018 issued to the corresponding KR Application No. 2015-7025458 with an English Translation.
Office Action received May 9, 2018 issued to the corresponding KR Application No. 2015-7025458 with an English Translation.
Office Action dated Apr. 27, 2017 issued in corresponding Chinese Application No. 201580014836.X with an English Translation.

* cited by examiner

COILER DEVICE AND GATE DEVICE PROVIDED WITH GUIDE UNIT

TECHNICAL FIELD

The present invention relates to a gate device provided with a guide unit, and to a coiler device.

BACKGROUND ART

In general, a coiler device (a winder) is provided on an exit side of a rolling line, and is configured to wind a metal strip (a strip) into a coil shape, where the metal strip is rolled by a rolling mill and continuously supplied from a gap between rollers. The coiler device is provided with pinch rollers located on a pass line for the metal strip, and is configured to cause the pinch rollers to guide the metal strip to a winding line which is bent obliquely downward from the pass line, to allow a leading end of the metal strip to be caught by a mandrel, and to wind up the metal strip (see Patent Document 1).

The coiler device includes a gate device located on an exit side of the pinch rollers. The gate device is configured to open and close the winding line, and closes the winding line except in the case of winding the metal strip through the winding line. The gate device described in Patent Document 1 includes a V-shaped body frame, and is configured to function as a strip passage table in a closed state and to function as a guide plate (a guide unit) in an open state for guiding an upper surface side of the metal strip introduced into the winding line.

PRIOR ART DOCUMENT

Patent Document

Patent Document 1: Japanese Patent Application Publication No. 2005-305452

SUMMARY OF THE INVENTION

Problems to be Solved by the Invention

In the meantime, after having passed through the pinch rollers, the metal strip is guided to the mandrel while deflecting its passing angle obliquely downward. Here, if the metal strip is a high-strength thick material, the metal strip is not bent very much due to its high bending stiffness, and is therefore thrust hard against the guide unit of the gate device at an entrance of the winding line. As a consequence, a surface of the metal strip is vulnerable to flaws and frictional resistance thereon is increased as well. Hence, a large pushing force is required and energy consumption is also increased accordingly.

The present invention has been made in view of the above-mentioned problem. An object of the present invention is to provide a gate device provided with a guide unit and to provide a coiler device, which are capable of preventing occurrence of flaws on a surface of a metal strip and stabilizing strip passage even when the metal strip is a high-strength thick material.

Means for Solving the Problems

In order to solve the problem described above, the present invention adopts a configuration of a gate device provided with a guide unit, characterized by a guide unit disposed on a downstream side of a pinch roller in a pass line on which a metal strip is conveyed, the guide unit being configured to open and close a winding line bent from the pass line, and to guide an upper surface side of the metal strip introduced into the winding line. The guide unit includes a body frame, and a liner being attached to the body frame, constituting at least part of a guide surface to guide the metal strip, and having a lower friction coefficient than a friction coefficient of the body frame and a lower hardness than a hardness of the metal strip.

As a consequence of adopting this configuration, in the present invention, at least part of the guide surface is formed from the liner having the lower friction than that of the body frame constituting the guide unit and having the lower hardness than that of the metal strip. The presence of the liner can reduce frictional resistance on the guide surface. Accordingly, it is possible to reduce energy consumption since it is not necessary to apply a very large pushing force to the metal strip. Moreover, since the liner has the lower hardness than that of the metal strip, it is the liner which is scraped off when the metal strip is thrust thereon. Thus, a surface of the metal strip is prevented from occurrence of flaws (from being scraped off).

In addition, the present invention adopts a configuration in which the liner comprises: a first liner attached to an upstream side of the body frame in the winding line; and a second liner attached to a downstream side of the body frame in the winding line, and having a larger thickness than a thickness of the first liner.

As a consequence of adopting this configuration, in the present invention, in the winding line, the second liner to be attached to the downstream side of the guide unit is formed thicker than the first liner to be attached to the upstream side of the guide unit. In the winding line, the downstream side of the guide unit rubs against the metal strip for a longer period than does the upstream side thereof. Accordingly, a scrape margin for the second liner can be secured by increasing the thickness of the second liner.

In addition, the present invention adopts a configuration in which the liner is detachably attached to the body frame.

As a consequence of adopting this configuration, in the present invention, it is possible to replace only the liner which rubs against the metal strip and gradually wears away. Thus, replacement workability is improved as compared to a case of replacing the liner together with the body frame, and a replacement cost can be reduced as well.

In addition, the present invention adopts a configuration in which the liner is formed from a plurality of pieces arranged in a width direction of the winding line, and the plurality of pieces are detachably attached to the body frame independently of each other.

As a consequence of adopting this configuration, in the present invention, when the metal strip is rolled out of a rolling mill, a shape of a leading end of the metal strip often fails to be aligned straight. As a consequence, the liner may be worn unevenly in the width direction. Hence, by forming the liner from the multiple pieces so as to be replaceable partially in terms of the width direction, it is possible to further reduce the replacement cost.

In addition, the present invention adopts a configuration of a coiler device characterized by: a pinch roller configured to guide a metal strip being conveyed along a pass line to a winding line bent from the pass line; a gate device configured to open and close the winding line; and a mandrel disposed ahead of the winding line and configured to wind up the metal strip. The coiler device includes the above-described gate device as the gate device.

Effect of the Invention

According to the present invention, it is possible to obtain a gate device provided with a guide unit and to obtain a coiler device, which are capable of preventing occurrence of flaws on a surface of a metal strip and stabilizing strip passage even when the metal strip is a high-strength thick material.

MODES FOR CARRYING OUT THE INVENTION

Embodiments of the present invention will be described below with reference to the drawings.

Figure 1:
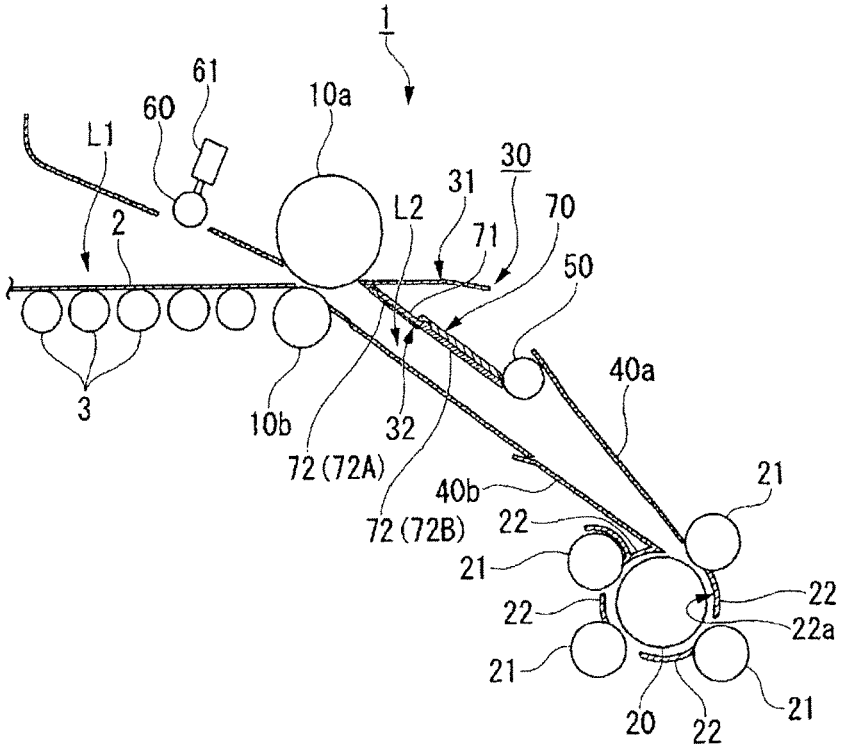
FIG. 1 is an overall configuration diagram showing a coiler device according to an embodiment of the present invention.

FIG. 1 is an overall configuration diagram showing a coiler device 1 according to an embodiment of the present invention.

As shown in FIG. 1, the coiler device 1 is disposed on a downstream side of a not-illustrated rolling mill, and is configured to introduce a metal strip 2, which passes through the rolling mill and is conveyed along a pass line L1, to a winding line L2 and thereby winding up the metal strip 2. The pass line L1 is defined by multiple conveyance rollers 3 that are arranged horizontally.

The coiler device 1 includes pinch rollers 10*a* and 10*b*. The pinch rollers 10*a* and 10*b* are designed to guide the metal strip 2, which is conveyed along the pass line L1, to the winding line L2 that is bent from the pass line L1. The winding line L2 extends obliquely downward from the pass line L1. The upper pinch roller 10*a* is made capable of approaching and receding from the lower pinch roller 10*b*. The upper pinch roller 10*a* is designed to recede from the lower pinch roller 10*b* except in the case of winding the metal strip 2 around a mandrel 20 to be described below.

The coiler device 1 includes the mandrel 20. The mandrel 20 is disposed ahead of the winding line L2 and designed to wind up the metal strip 2. Multiple wrapper rollers 21 and wrapper aprons 22 are provided around the mandrel 20. The wrapper rollers 21 are provided for wrapping the metal strip 2 around the mandrel 20. The wrapper rollers 21 are disposed at intervals in a circumferential direction of the mandrel 20. The wrapper rollers 21 are made capable of approaching and receding from the mandrel 20. The wrapper rollers 21 are designed to move in conformity with a diameter of the metal strip 2 wrapped around the mandrel 20.

The wrapper aprons 22 are designed to guide a leading end of the metal strip 2 when the metal strip 2 is wrapped around the mandrel 20. Each wrapper apron 22 has a guide surface 22*a*, which is opposed to a peripheral surface of the mandrel 20, and allows the leading end of the metal strip 2 to come into contact therewith. The guide surface 22*a* is curved along the peripheral surface of the mandrel 20. Each wrapper apron 22 is disposed in a space between two corresponding wrapper rollers 21 adjacent to each other in the circumferential direction of the mandrel 20. The wrapper aprons 22 are made capable of approaching and receding from the mandrel 20. The wrapper aprons 22 are designed to recede from the mandrel 20 when the metal strip 2 is wrapped therearound.

The coiler device 1 includes a gate device 30. The gate device 30 is configured to open and close the winding line L2 (FIG. 1 shows an open state). The gate device 30 is disposed on an exit side of the pinch rollers 10*a* and 10*b*. The gate device 30 includes a first guide surface 31 that defines the pass line L1, and a second guide surface 32 (guide surface) that defines the winding line L2. The first guide surface 31 is formed into a horizontal surface extending along the pass line L1. The second guide surface 32 is formed into an inclined surface extending along the winding line L2.

The gate device 30 defines the winding line L2 in conjunction with chute guides 40*a* and 40*b*. The chute guides 40*a* and 40*b* are designed to guide the leading end of the metal strip 2 to a catch part between the mandrel 20 and the corresponding wrapper roller 21. The chute guides 40*a* and 40*b* are arranged in a downward tapered fashion such that a clearance therebetween is gradually narrowed toward the catch part between the mandrel 20 and the wrapper roller 21. The chute guides 40*a* and 40*b* are disposed on a downstream side of the gate device 30 in the winding line L2. In this embodiment, the lower chute guide 40*b* is provided integrally with one of the wrapper aprons 22.

The coiler device 1 includes a chute roller 50. The chute roller 50 is configured to suppress a deformation of the metal strip 2 in such a way as to be curved toward its upper surface side when the leading end of the metal strip 2 is wrapped around the mandrel 20. The chute roller 50 is disposed at a position corresponding to a joint between the gate device 30 and the upper chute guide 40*a*, which is disposed on the downstream side of the gate device 30 on the winding line L2. The chute roller 50 is rotatably provided and its peripheral surface projects from the second guide surface 32.

The coiler device 1 includes a bending roller 60. The bending roller 60 is disposed on an upstream side of the pinch rollers 10*a* and 10*b*, and is made capable of approaching and receding from the pass line L1 by use of a bending roller drive device 61. The bending roller 60 is configured to approach the pass line L1 when the rolling of the metal strip 2 is about to finish, so as to prevent its trailing end from bouncing up. The bending roller drive device 61 is formed from a cylinder device, for example.

Next, a configuration of the gate device 30 will be described in detail while additionally referring to FIG. 2 and FIG. 3.

Figure 2:
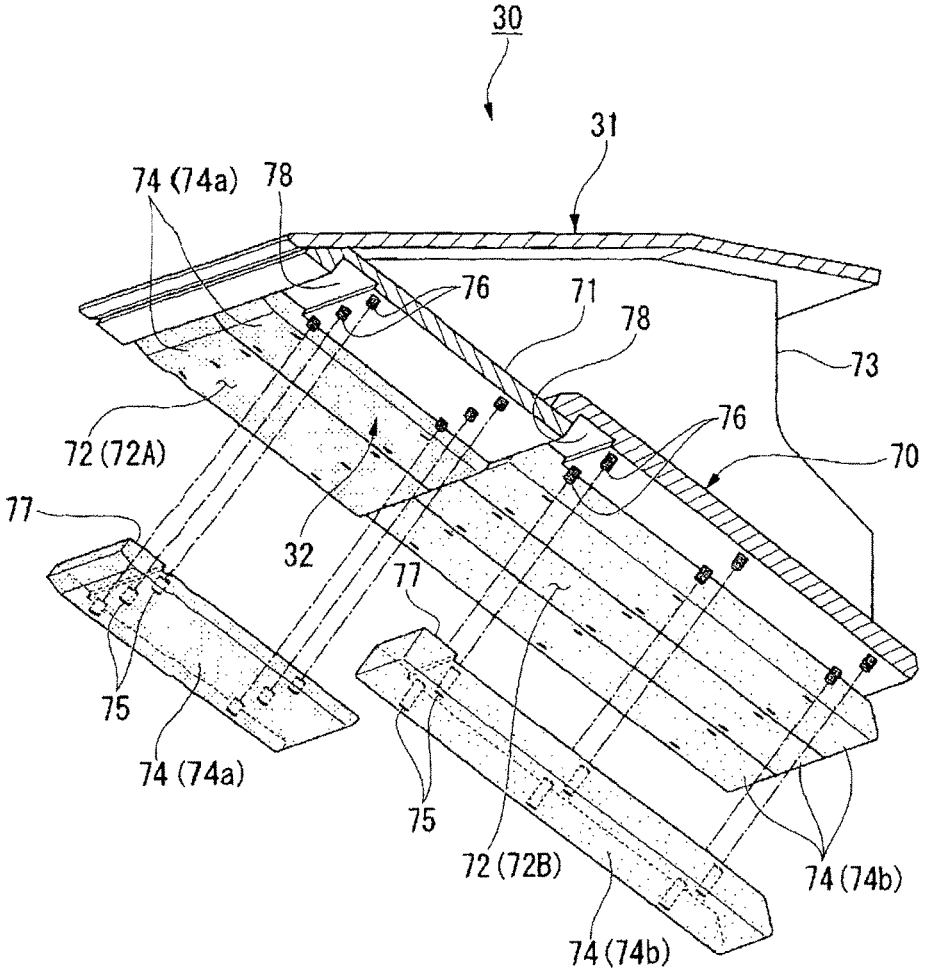
FIG. 2 is a partially exploded perspective view of a gate device according to the embodiment of the present invention, which is viewed from a lower side.

FIG. 2 is a partially exploded perspective view of the gate device 30 according to the embodiment of the present invention, which is viewed from a lower side. FIG. 3 is a partially exploded perspective view of the gate device 30 according to the embodiment of the present invention, which is viewed from an upper side.

The gate device 30 includes a guide unit 70. The guide unit 70 constitutes the second guide surface 32 which guides the upper surface side of the metal strip 2 introduced into the winding line L2 (see FIG. 1). The guide unit 70 includes a body frame 71. The body frame 71 develops a substantially V-shaped shape a leading end of which is directed to an upstream side of the pass line L1. An upper surface side of the body frame 71 constitutes the first guide surface 31, while liners 72 are attached to a lower surface side of the body frame 71, thus constituting the second guide surface 32. As shown in FIG. 3, multiple reinforcement ribs 73 are provided in a V-shaped groove of the body frame 71.

The guide unit 70 includes the liners 72. As shown in FIG. 1, the liners 72 are attached to the body frame 71 and thus constitute at least part of the second guide surface 32 that guides the metal strip 2. The liners 72 are formed from a low friction material having a lower friction coefficient than that of the body frame 71, which is also a low hardness material having a lower hardness than that of the metal strip 2. The liners 72 of this embodiment are made of an FCD (ductile cast iron) material, for example.

The liners 72 include a first liner 72A and a second liner 72B, and are thus formed from two liner materials in the winding line L2. The first liner 72A is attached to an upstream side of the body frame 71 in the winding line L2. The second liner 72B is attached to a downstream side of the body frame 71 in the winding line L2. The second liner 72B has a thickness which is equal to or more than twice as large as that of the first liner 72A.

Figure 3:
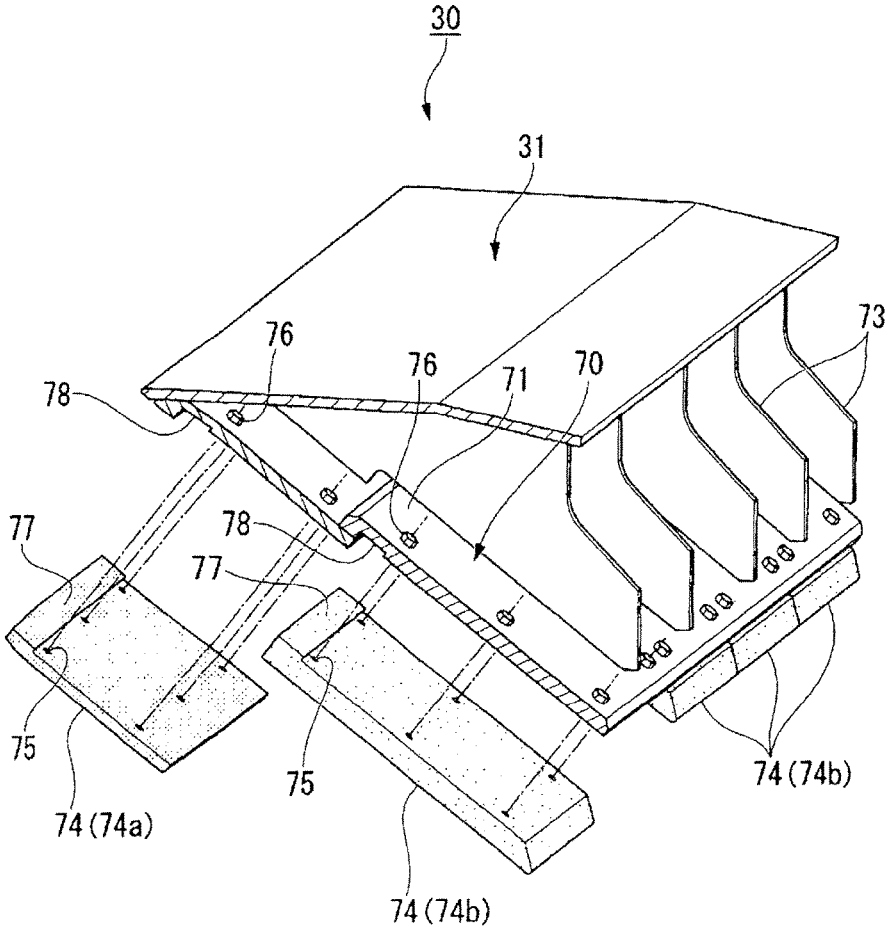
FIG. 3 is a partially exploded perspective view of the gate device according to the embodiment of the present invention, which is viewed from an upper side.

As shown in FIG. 2 and FIG. 3, the liners 72 are detachably attached to the body frame 71. The liners 72 of this embodiment are formed from multiple pieces 74 arranged in a width direction of the winding line L2, and the multiple pieces 74 are detachably attached to the body frame 71 independently of one another. The first liner 72A adopts a configuration including three pieces 74 (each of which may be hereinafter referred to as a first piece 74*a* as appropriate), so that each of the three pieces 74 is independently replaceable. In the meantime, the second liner 72B adopts a configuration including four pieces 74 (each of which may be hereinafter referred to as a second piece 74*b* as appropriate), so that each of the four pieces 74 is independently replaceable.

Screw holes 75 are formed in each piece 74. Each screw hole 75 is formed to penetrate the piece 74. The piece 74 is fastened and fixed to the body frame 71 by threadedly engaging a bolt 76 with the screw hole 75 from a back side of the piece 74. Meanwhile, a projection 77 that projects to the back side is formed on the piece 74. The projection 77 is formed on the back of the piece 74 and on the upstream side of the winding line L2. Engagement grooves 78 each in a recessed shape so as to correspond to the projecting shape of the projections 77 are formed on the body frame 71.

By bringing the projections 77 into engagement with the engagement grooves 78, the pieces 74 can be positioned on the body frame 71 so that the bolts 76 can be inserted easily. In addition, it is possible to prevent the pieces 74 from slipping with respect to the body frame 71 in an extending direction of the winding line L2. In other words, by bringing the projections and the engagement grooves 78 into engagement in the extending direction of the winding line L2, a shear stress to be applied to the bolts 76 at the time of friction with the metal strip 2 can be reduced. Accordingly, it is possible to keep the numbers of installation of the bolts 76 and the screw holes 75 fewer, and to keep the sizes of their diameters smaller.

Next, an operation to wind the meal strip 2 by the coiler device 1 having the above-described configuration and an action of the gate device 30 will be described with reference to FIG. 4. Note that a description is given below of a case where the metal strip 2 is a high-strength thick material.

Figure 4A:
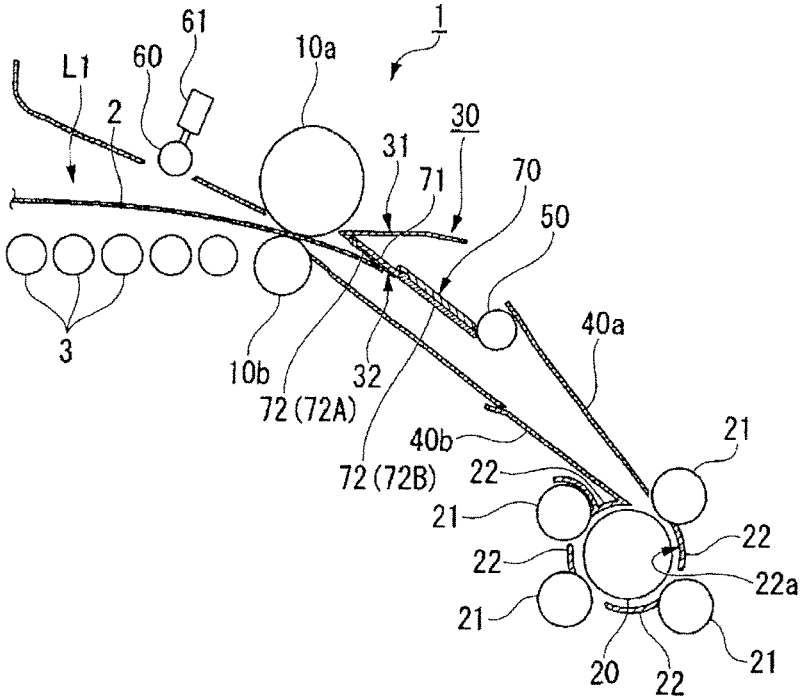
FIG. 4 illustrates diagrams for explaining a winding operation of the coiler device and an action of the gate device according to the embodiment of the present invention.
Figure 4B:
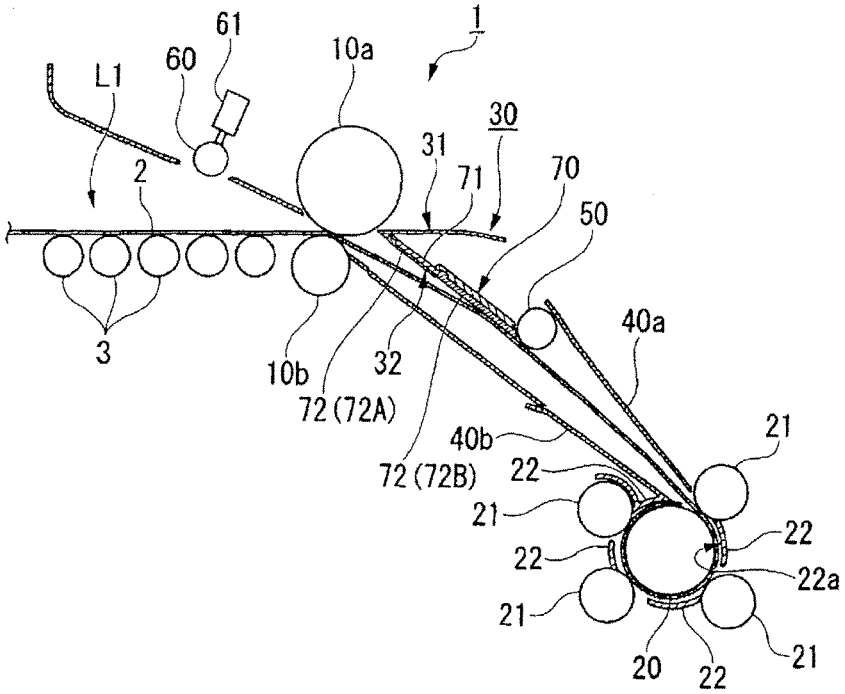

FIG. 4 illustrates diagrams for explaining a winding operation of the coiler device 1 and an action of the gate device 30 according to the embodiment of the present invention.

As shown in FIG. 4(*a*), the metal strip 2 having passed through the not-illustrated rolling mill is conveyed along the pass line L1 and reaches the pinch rollers 10*a* and 10*b*. After having passed through the pinch rollers 10*a* and 10*b*, the metal strip 2 changes its passing angle obliquely downward and is hence guided to the winding line L2 which is bent from the pass line L1. Here, when the metal strip 2 is the high-strength thick material, its leading end is not bent enormously but is instead curved in such a way as to draw an arc. As a consequence, the metal strip 2 is thrust against the guide unit 70 of the gate device 30 at the entrance of the winding line L2.

The guide unit 70 includes the second guide surface 32 which guides the upper surface side of the metal strip 2 introduced into the winding line L2. At least part of the second guide surface 32 is formed from the liners 72. The liners 72 are made of the low friction material having the lower friction coefficient than that of the body frame 71 constituting the guide unit 70, and thus reduce frictional resistance against the metal strip 2. In this way, by attaching the liners 72 to the body frame 71 and reducing the frictional resistance on the second guide surface 32, it is possible to reduce energy consumption since it is not necessary to apply a very large pushing force to the metal strip 2.

Moreover, since the liners 72 are made of the low hardness material having the lower hardness than that of the metal strip 2, it is the liners 72 side which are scraped off when the metal strip 2 is thrust thereon. Thus, the surface of the metal strip 2 is prevented from occurrence of flaws (from being scraped off). Accordingly, in this embodiment, at least part of the second guide surface 32 is formed from the liners 72 having the lower friction than that of the body frame 71 constituting the guide unit 70 and having the lower hardness than that of the metal strip 2. Thus, it is possible to reduce the frictional resistance, to stabilize strip passage without the need to apply a large pushing force to the metal strip 2, and meanwhile, to prevent the surface of the metal strip 2 from occurrence of flaws by abrading the liners 72 side.

As shown in FIG. 4(*a*), the leading end of the metal strip 2 introduced into the winding line L2 is first thrust at the first liner 72A. Thereafter, as shown in FIG. 4(*b*), the metal strip 2 is thrust at the second liner 72B disposed on the downstream side of the winding line L2, then passes through a space between the chute guides 40*a* and 40*b*, and is wound around the mandrel 20. When the metal strip 2 is the high-strength thick material, the metal strip 2 will remain thrust at the second liner 72B for some time while being wound around the mandrel 20.

As described above, in the winding line L2, the metal strip 2 is thrust on the downstream side of the guide unit 70 for a longer period than is on the upstream side thereof. As a consequence, a wear amount of the second liner 72B is larger than that of the first liner 72A. Regarding the liners 72 of this embodiment, in the winding line L2, the second liner 72B to be attached to the downstream side of the guide unit 70 is formed thicker than the first liner 72A to be attached to the upstream side of the guide unit 70. According to this configuration, a scrape margin for the second liner 72B can be secured by increasing the thickness of the second liner 72B. Thus, it is possible to perform an adjustment such that replacement timing (a wear rate) of the first liner 72A becomes substantially equal to that of the second liner 72B.

Meanwhile, the liners 72 of this embodiment are detachably attached to the body frame 71 by using the bolts 76. Accordingly, it is possible to replace only the liners 72, which rub against the metal strip 2 and gradually wear away, separately from the body frame 71. As a consequence, replacement workability is improved as compared to the case of replacing the liners 72 together with the body frame 71, and a replacement cost can be reduced as well. Moreover, as shown in FIG. 2, the liners 72 are composed of the multiple pieces 74 arranged in the width direction of the winding line L2, and the multiple pieces 74 are detachably attached to the body frame 71 independently of one another. A weight of each of the pieces 74 is obviously lighter than a total weight of the liners 72, so that it is easy to conduct replacement work.

In the meantime, when the metal strip 2 is rolled out of the not-illustrated rolling mill, the shape of the leading end of the metal strip 2 often fails to be aligned straight. Accordingly, when the leading end of the metal strip 2 is thrust at the guide unit 70, the liners 72 may be worn unevenly in the width direction. In this embodiment, the liners 72 are formed from the multiple pieces 74 so as to be replaceable partially in terms of the width direction, thereby allowing the replacement of only the unevenly worn part, for example. As a consequence, it is possible to further reduce the replacement cost for the liners 72.

In this way, the above-described embodiment adopts the configuration of the gate device 30 provided with the guide unit 70, including: the guide unit 70 disposed on the downstream side of the pinch rollers 10*a* and 10*b* in the pass line L1 on which the metal strip 2 is conveyed, and configured to open and close the winding line L2 bent from the pass line L1 and to guide the upper surface side of the metal strip 2 introduced into the winding line L2, in which the guide unit 70 includes the body frame 71, and the liner 72 being attached to the body frame 71, constituting at least part of the second guide surface 32 guiding the metal strip 2 and having the lower friction coefficient than that of the body frame 71 and the lower hardness than that of the metal strip 2. Thus, it is possible to obtain the gate device 30 provided with the guide unit 70 and to obtain the coiler device 1, which are capable of preventing occurrence of flaws on the surface of the metal strip 2 and stabilizing strip passage even when the metal strip 2 is the high-strength thick material.

The preferred embodiment of the present invention has been described above with reference to the drawings. It is to be understood, however, that the present invention is not limited only to the above-described embodiment. The shapes, combinations, and other features of the respective constituents shown in the above-described embodiment are mere examples, and various modifications based on design requirements and the like are possible within the range not departing from the gist of the present invention.

Figure 5:
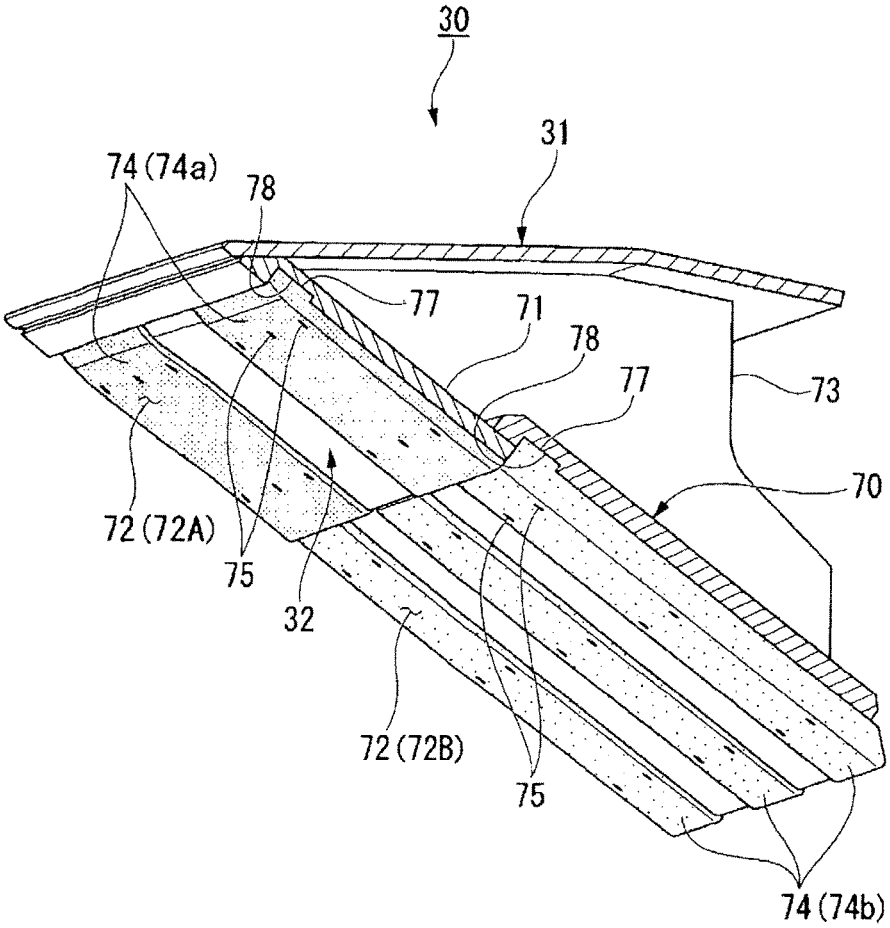
FIG. 5 is a perspective view of a gate device according to another embodiment of the present invention, which is viewed from a lower side.

For example, the present invention may adopt the following aspect shown in FIG. 5. Note that in the following description, constituents which are identical or similar to those in the above-mentioned embodiment will be denoted by the same reference numerals and the description thereof will be either simplified or omitted.

FIG. 5 is a perspective view of the gate device 30 according to another embodiment of the present invention, which is viewed from a lower side.

As shown in FIG. 5, the liners 72 of the other embodiment are attached to the body frame 71 in such a way as to form duckboards. Specifically, the first liner 72A is formed from two first pieces 74*a* and a gap is defined between the first pieces 74*a* adjacent to each other in the width direction of the winding line L2. In the meantime, the second liner 72B is formed from three second pieces 74*b* and a gap is defined between every two second pieces 74*b* adjacent to each other in the width direction of the winding line L2.

For this reason, regarding the second guide surface 32 on the upstream side, the center is formed from the body frame 71 and two sides thereof are formed from the first liner 72A. Meanwhile, regarding the second guide surface 32 on the downstream side, the center and two lateral ends are formed from the second liners 72B and the gaps therebetween are formed from the body frame 71. This configuration can reduce the number of the pieces 74 and facilitate the replacement work of the liners 72. In the meantime, two end portions in the width direction of the second guide surface 32 are apt to be hit by corners of the metal strip 2. Accordingly, by attaching the liners 72 at least to the two end portions, it is possible to effectively suppress occurrence of flaws on the metal strip 2.

Meanwhile, for example, the embodiments have described the configuration in which each liner is formed from the multiple pieces. However, the present invention is not limited only to this configuration. For instance, the liner may be formed from a single piece.

EXPLANATION OF REFERENCE NUMERALS

1 coiler device
2 metal strip
10*a*, 10*b* pinch roller
20 mandrel
30 gate device
32 second guide surface (guide surface)
70 guide unit
71 body frame
72 liner
72A first liner
72B second liner
74 piece
L1 pass line
L2 winding line

The invention claimed is:

1. A gate device provided with a guide unit, wherein
a guide unit disposed on a downstream side of a pinch roller in a pass line on which a metal strip is conveyed, the guide unit being configured to open and close a winding line bent from the pass line, and to guide an upper surface side of the metal strip introduced into the winding line, and wherein
the guide unit includes
a body frame, and
a liner being attached to the body frame, constituting at least part of a guide surface to guide the metal strip, and having a lower friction coefficient than a friction coefficient of the body frame and a lower hardness than a hardness of the metal strip; and wherein
the liner comprises:
a first liner detachably attached to an upstream side of the body frame in the winding line; and
a second liner detachably attached to a downstream side of the body frame in the winding line, and having a larger thickness than a thickness of the first liner.

2. The gate device provided with a guide unit according to claim 1, wherein
the first liner and the second liner are each formed from a plurality of pieces arranged in a width direction of the winding line, and the plurality of pieces are detachably attached to the body frame independently of each other.

3. A coiler device comprising:

a pinch roller configured to guide a metal strip being conveyed along a pass line to a winding line bent from the pass line;

the gate device according to claim 1, configured to open and close the winding line; and a mandrel disposed ahead of the winding line and configured to wind up the metal strip.

4. A coiler device comprising:

a pinch roller configured to guide a metal strip being conveyed along a pass line to a winding line bent from the pass line;

the gate device according to claim 2, configured to open and close the winding line; and a mandrel disposed ahead of the winding line and configured to wind up the metal strip.

* * * * *